US005176561A

United States Patent [19]

Greenberg et al.

[11] Patent Number: 5,176,561

[45] Date of Patent: Jan. 5, 1993

[54] TOY NURSING BOTTLE FOR A DOLL

[75] Inventors: Lawrence J. Greenberg, New Rochelle; Gregory E. Hyman, Pound Ridge; Judith H. Blau, Eastchester, all of N.Y.; Michele P. Trammel, Williamsburg, Ohio

[73] Assignee: Kenner Products, Division of Tonka Corp., Cincinnati, Ohio

[21] Appl. No.: 771,406

[22] Filed: Oct. 2, 1991

[51] Int. Cl.[5] ..... A63H 5/32; A63H 3/24; A61J 9/04; B67D 3/00

[52] U.S. Cl. ..... 446/267; 446/305; 446/483; 222/518; 215/11.4

[58] Field of Search ..... 446/267, 304, 305, 483, 446/227, 224; 222/632, 518, 508; 215/11.4, 11.1

[56] References Cited

U.S. PATENT DOCUMENTS

| | | | |
|---|---|---|---|
| 2,555,107 | 5/1951 | Beebe | 446/305 |
| 3,151,787 | 10/1964 | Miller | 222/518 |
| 3,237,340 | 3/1966 | Knott | 446/267 |
| 3,245,174 | 4/1966 | Gardell et al. | 446/267 |
| 3,601,287 | 8/1971 | Schwartzman | 222/518 X |
| 4,135,513 | 1/1979 | Arisland | 215/11.4 |
| 4,186,513 | 2/1980 | Blum | 446/267 |
| 4,570,826 | 2/1986 | Fattori | 222/518 X |
| 4,640,424 | 2/1987 | White | 215/11.4 X |
| 4,693,696 | 9/1987 | Buck | 446/224 |

FOREIGN PATENT DOCUMENTS

| | | | |
|---|---|---|---|
| 697356 | 11/1964 | Canada | 446/267 |
| 699656 | 12/1964 | Canada | 446/267 |
| 2235718 | 3/1975 | France | 446/267 |
| 2415475 | 9/1979 | France | 446/267 |
| 436502 | 10/1935 | United Kingdom | 446/267 |

*Primary Examiner*—D. Neal Muir
*Attorney, Agent, or Firm*—Darby & Darby

[57] ABSTRACT

A toy nursing bottle for simulating emptying of the bottle when the doll is "drinking" and "filling" the bottle from a can or the like. The bottle body is formed of outer and inner shells defining a liquid receiving chamber therebetween, a nipple member mounted on the bottle body and having a liquid receiving reservoir, and a valve that controls flow of liquid between the liquid receiving chamber and the liquid receiving reservoir. A rod extends from the valve member through the reservoir and into the nipple, so that it moves, when the nipple is depressed, to open the valve. Any surface on a container, such as a can, bottle or cardboard container or the like, may be used to depress the nipple to open the valve.

8 Claims, 2 Drawing Sheets

TOY NURSING BOTTLE FOR A DOLL

BACKGROUND OF THE INVENTION

1. Field of the Invention

The invention relates to a toy nursing bottle for a doll for simulating drinking of milk or other beverages. In particular, the invention relates to a toy nursing bottle for a doll which adds realism to the action of drinking by showing emptying of the bottle during drinking and filling the bottle with a beverage or milk upon pressing a container "filled" with the beverage or milk to the bottle nipple.

Toy nursing bottles for dolls are known. U.S. Pat. No. 4,990,119 to Amici et al. discloses a toy nursing bottle having inner and outer shells defining a relatively narrow annular chamber therebetween filled with a colored liquid simulating milk or other beverages. The bottle portion which is adjacent to the nipple has a liquid receiving reservoir that communicates with the chamber between the inner and outer shells through a narrow opening. Upon tipping of the bottle downwardly, there is produced a slow drainage of the colored liquid from the annular chamber into the liquid receiving reservoir simulating emptying of the bottle. To add realism to the action, the inner shell is filled with a clear liquid and a flow of air is directed into the inner shell to generate bubbles. The flow of air into the inner shell is effected by pressing the nipple, which is resilient, against the lips of a doll. The nipple actuates a valve which controls flow of air into the inner shell. When the bottle is returned to its normal vertical position, the colored liquid from the liquid receiving reservoir flows back into the chamber between the inner and outer shell. The Amici toy nursing bottle, therefore, does not have an appearance of an empty bottle upon returning the bottle to the vertical position after completion of the drinking action.

A toy vessel that adds realism to the action of drinking by showing emptying of the vessel upon drinking and filling it with a beverage upon approaching a container "filled" with the beverage is disclosed in U.S. Pat. No. 3,250,531 to Convertine. U.S. Pat. No. 3,250,531 discloses a toy glass having inner and outer shells defining a narrow space therebetween filled with a colored liquid and a liquid receiving reservoir adjacent to the outer rim of the glass and defined by two horizontal walls. The inner wall of the glass has an opening through which fluid is able to flow from the space between the inner and outer shells into the liquid receiving chamber. The opening is closed by a magnetic and gravity valve. Upon tipping of the glass to show a drinking action, the valve moves away from the opening under the force of gravity, and fluid flows from the space between the inner and outer shells into the liquid receiving chamber, simulating a drinking action. When the glass is returned to its vertical position, the valve, under the action of gravity, drops back into the opening, preventing back flow of the liquid from the liquid receiving reservoir into the space between the two vessels, giving an appearance of an empty glass. When the container is approached to the glass as to pour liquid thereinto, a magnetic element located adjacent to the "pouring" orifice of the container acts on the valve and lifts it out of the opening so that the liquid can flow from the liquid receiving reservoir into the space between the two shells, giving an appearance of filling the glass from the container. While this toy provides a realistic impression of a drinking action from the glass, both the valve and the carton have to be provided with cooperating magnetic elements.

SUMMARY OF THE INVENTION

The object of the invention is to provide a toy nursing bottle for a doll for simulating drinking of milk or other beverages which gives a realistic impression of an emptying and filling action while being simple in structure and not requiring magnetic or similar elements.

The object of the invention is achieved by providing a toy nursing bottle including a pressure operated valve which controls flow of liquid between the liquid receiving chamber in the bottle body and the liquid receiving reservoir provided in the nipple member. The toy nursing bottle, according to the invention, comprises a bottle body formed of at least partially transparent outer and inner shells which define a liquid receiving chamber therebetween. The bottle body has a neck portion, and the outer shell has an opening at an end of the neck portion, which opening communicates with the liquid receiving chamber. A nipple member is connected with the bottle body at the neck portion of the bottle body and includes a resilient nipple and a wall which defines the liquid receiving reservoir. Preferably, the bottle has a cap which is mounted on the neck of the bottle body, and the nipple member is located inside the cap with the nipple projecting through a cap opening remote from the neck portion. Valve means which control the flow of fluid between the liquid receiving chamber and the reservoir include a valve member which cooperates with a seat surface provided on the wall of the nipple member which defines the liquid receiving reservoir, and is movable relative to the seat surface to enable flow of the liquid between the liquid receiving chamber in the bottle body and the liquid receiving reservoir in the nipple member. The valve member includes a rod member projecting from the valve member and having an end portion received within the nipple, which is hollow. In this way, upon depression of the nipple, the valve moves away from the seat surface enabling flow of the liquid. The inner shell may have, on the end surface thereof which is adjacent to the neck portion, a projecting pin received in a groove formed in the valve member for guiding the valve member in its displacement relative to the seat surface.

When in use, the nipple of the bottle, when pressed against the lips of a doll, will compress, moving the valve member out of engagement with the seat surface, and the liquid from the liquid receiving chamber will flow into the liquid receiving reservoir in the nipple member, giving an appearance of feeding the doll. When the bottle is removed from contact with the doll's lips, the nipple will restore under resilient force, and the valve member will again engage the seat surface, preventing flow of liquid from the liquid receiving reservoir into the liquid receiving chamber in the bottle body irrespective of the tilted or upright position of the bottle.

The bottle may be used with a toy can container which may be made to contain liquid simulating milk or other beverages. However, for even more realism, real baby formula or actual milk containers may be used. Upon pressing the end surface of such container against the resilient nipple, with the toy bottle in an upright, i.e., filling position, the nipple will be compressed, resulting in displacement of the valve member out of engagement with the seat surface, and the liquid from the liquid receiving reservoir in the nipple member will flow into the liquid receiving chamber in the bottle body, giving an appearance of filling the bottle. Upon removing of the can or milk container out of engagement with the nipple, the nipple will again restore to its original form, and the bottle will be again "full".

The above-mentioned and other features and objects of the present invention and the manner of obtaining them will become more apparent, and the invention itself will be best understood, from the following detailed description of the preferred embodiment of the invention when read with reference to the accompanying drawings.

DETAILED DESCRIPTION OF THE PREFERRED EMBODIMENTS

Figure 2:
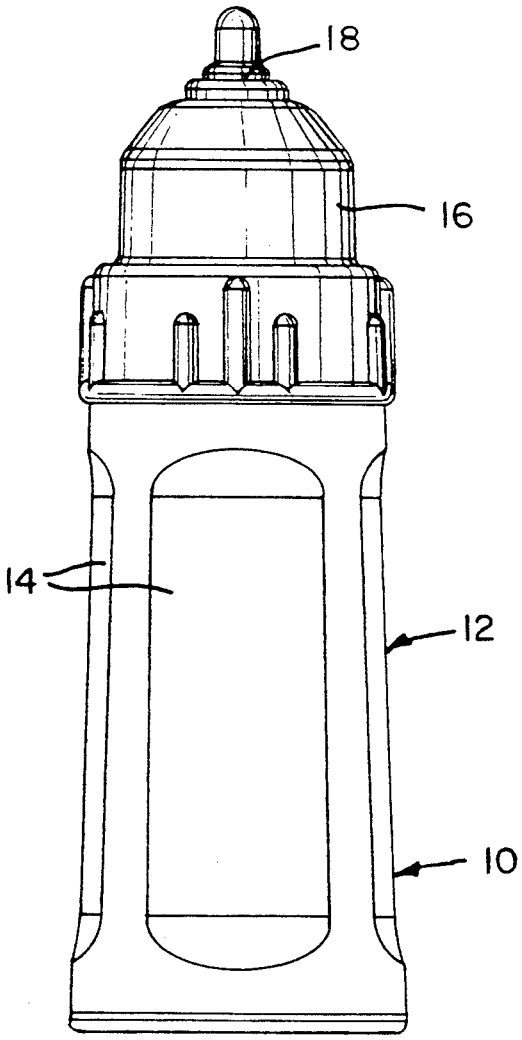
FIG. 2 is a front elevational view of a toy nursing bottle according to the present invention.
Figure 3:
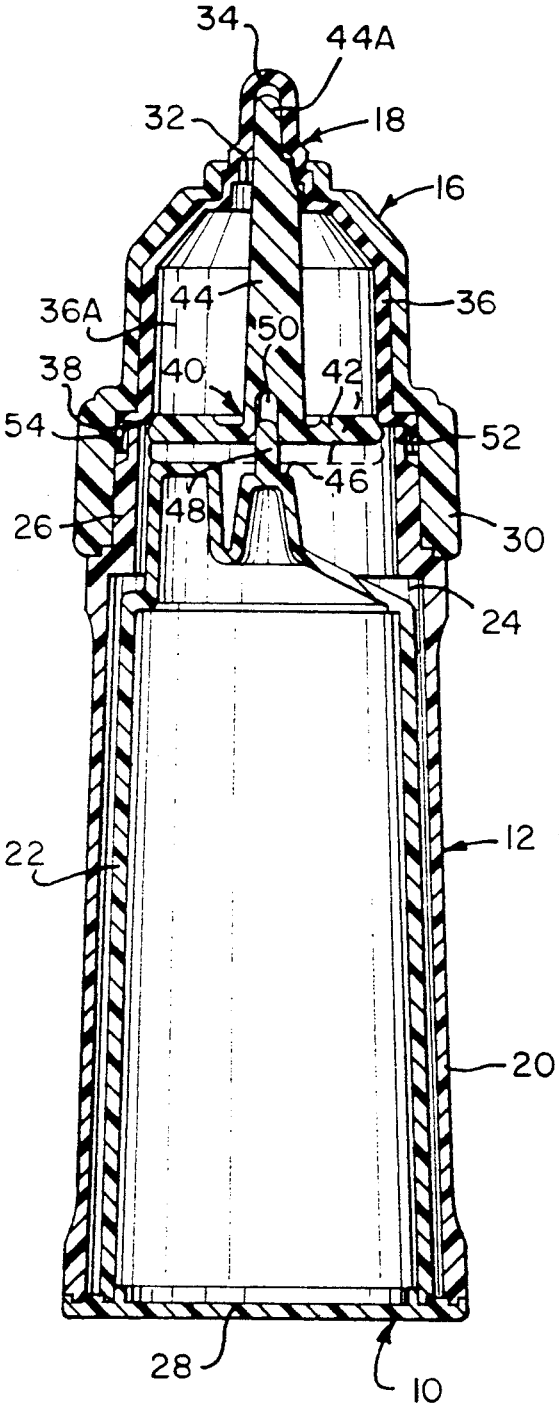
FIG. 3 is a longitudinal cross-sectional view of the toy nursing bottle shown in FIG. 2.

A toy nursing bottle shown in FIG. 2 includes a bottle body 12 having transparent portion 14, a cap 16 mounted on the neck portion of the bottle body 12, and a nipple member 18 of which only the nipple is visible in FIG. 2. As shown in FIG. 3, the bottle body 12 includes an outer shell 20 and an inner shell 22 which together define a liquid receiving chamber 24 therebetween. The outer and inner shell preferably are made from a plastic material. The bottle body 12 has a neck portion 26 and a bottom 28. The cap 16 has an end portion 30 which is preferably permanently mounted, e.g., cemented, on the neck portion of the bottle body. To this end, the neck portion may, for factory assembly purposes, have an outer thread cooperating with the inner thread of the end portion 30 of the cap 16. The cap 16 also has an opening 32 at and end thereof remote from the mounting end portion 30. The nipple member 18 is located inside the cap and has a resilient nipple 34 which projects through the opening 32. Preferably, the nipple member is made of a rubber-like material. The nipple member 18 has a wall 36 which defines a liquid receiving reservoir 36A. The wall 36 has a seat surface 38. A valve 40 controls flow of liquid between the liquid receiving chamber 24 and the liquid receiving reservoir 36A. The valve 40 consists of a valve member 42 engageable with the seat surface 38 and a rod member 44 extending from the valve member 32 and having an end portion 44A extending into the hollow resilient nipple 34. The inner shell 22 has an end surface 46 from which a pin-like member 48 projects into the groove 50 formed in the valve member for guiding the valve in its displacement relative to the seat surface 38. As shown in FIG. 3, the neck portion may have a rim portion 52 having a diameter slightly reduced in comparison with the outer diameter of the neck portion. The nipple member may have a flange portion 54 mounted on the rim portion of the neck. The end portion 44A of the rod member 44 may be fixedly received in the nipple 34 or may be glued to the inner surface thereof.

Figure 4:
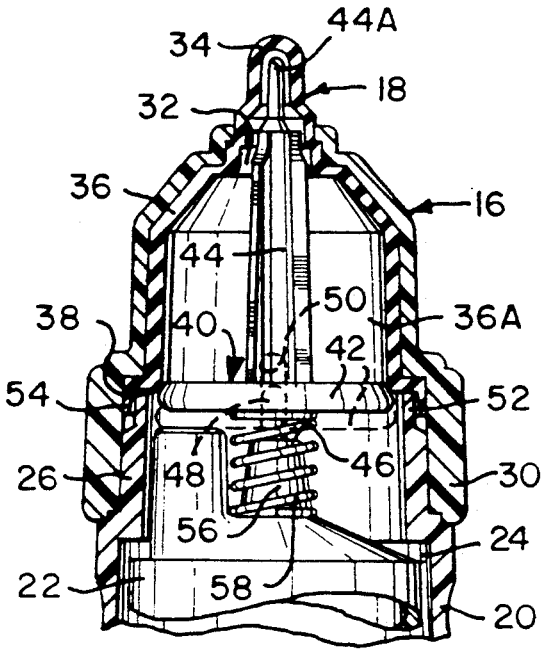
FIG. 4 is a partial cross-sectional view of the nipple and valve portion of another embodiment of a toy nursing bottle according to the invention.

FIG. 4 shows another embodiment of a toy nursing bottle according to the present invention. In FIG. 4, similar elements are designated with the same reference numerals. As shown in FIG. 4, the end portion 44A of the rod member 44 of the valve 40 is received in the nipple with a small clearance. The inner shell 22 has a boss portion 56 from which the pinlike member 48 projects into the groove 50 of the valve member 42. A compression spring 58 is supported on the boss portion 56 and engages the valve member 42 to bias it into engagement with the seat surface 38 of the nipple member.

Figure 1:
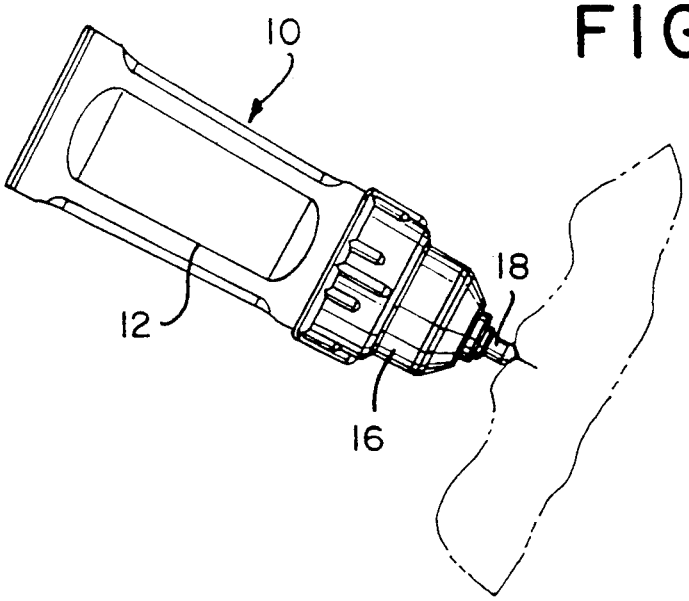
FIG. 1 is a view showing simulated drinking by a doll from a toy nursing bottle according to the invention.

The toy nursing bottle, according to the invention, is used in the following manner. A child may press the nipple 34 of the tilted bottle 10 against the lips of a doll, as shown in FIG. 1. Upon the nipple 34 being compressed, the valve member 42 moves from the seat surface 38 to a position shown in dash lines in FIG. 3. The liquid from the liquid receiving chamber 24 flows through the clearance between the seat surface 48 and the valve member 42 into the liquid receiving reservoir 36A in the nipple member 18. When all liquid from the liquid receiving chamber 24 has flowed into the liquid receiving reservoir 36, the child takes the bottle away from the lips of the doll. The nipple 34 restores its shape under the resilient force, and the rod member 44 moves together with the nipple, moving the valve member 42 again into engagement with the seat surface 38 and held there by the resilient force of the rubber or rubber-like nipple. The valve member blocks flow of liquid back from the reservoir 36A into the liquid receiving chamber 24 and maintains the liquid in the reservoir 36A, even after the bottle is placed upright on a table or the like.

Figure 5:
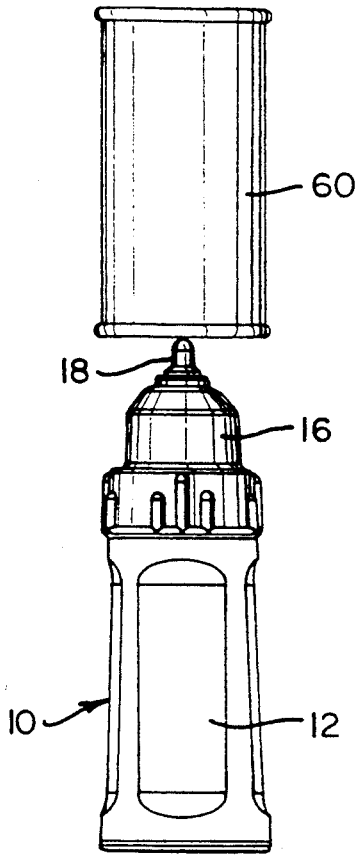
FIG. 5 is a front elevational view showing a can in the bottle filling position above the toy nursing bottle according to the invention.

If the child wants to "fill" the bottle, the child takes the can 60, shown in FIG. 5, or any other container, such as an actual milk can or container, and presses it downwardly against the top of the resilient nipple 34 of the upright bottle, compressing it. The deformation of the nipple results in the rod member 44 moving down. This moves the valve member 42 out of engagement with the seat surface 38, allowing gravity to provide for back flow of liquid from the liquid receiving reservoir 36A into the liquid receiving chamber 24. When all liquid from the liquid receiving reservoir 36A has passed into the liquid receiving chamber 24, the child lifts the can or other container away from contact with the nipple 34, releasing the pressure thereon. The upright bottle is again "full" with "beverage". Thus, any surface of any real or play can container or bottle may be used to accomplish the play "pouring" of liquid from container to bottle to create the impression of "filling" the latter.

While particular embodiments of the invention have been shown and described, various modifications thereof will be apparent to those skilled in the art and, therefore, it is not intended that the invention be limited to the disclosed embodiments or to the details thereof, and that departures may be made therefrom within the spirit and scope of the invention as defined in the appended claims.

What is claimed is:

1. A toy nursing bottle for dolls comprising:

a bottle body having at least partially transparent outer and inner shells defining a liquid receiving chamber therebetween, and a neck portion, the outer shell having an opening at an end thereof adjacent to the neck portion and communicating with the liquid receiving chamber;

a nipple member connected with the bottle body at the neck portion of the bottle body and including a compressible nipple and a wall having a seat surface and defining a liquid receiving reservoir between the nipple and the seat surface; and valve means for controlling flow of liquid between the liquid receiving chamber of the bottle body and the liquid receiving reservoir of the nipple member, the valve means including a valve member engaging the seat surface to block flow of liquid therepast, and a rod member associated with the valve member and having an end portion cooperating with the nipple, the rod member being displaceable with the nipple upon compressing the nipple to thereby displace the valve member away from the seat surface to allow gravity flow of liquid between the liquid receiving chamber and the liquid receiving reservoir.

2. A toy nursing bottle as set forth in claim 1, wherein the inner shell is a closed body and the compressible nipple comprises a hollow nipple made of a resilient material.

3. A toy nursing bottle as set forth in claim 1, further comprising a cap having an end portion mounted on the neck portion of the bottle body, and an opening at an end thereof remote from the mounted end portion, the nipple member having a portion located inside the cap with the compressible nipple projecting through the opening of the cap.

4. A toy nursing bottle as set forth in claim 1, wherein the valve member has a central opening, the inner shell having an end surface and a pin-like member projecting therefrom and extending into the opening for guiding the valve member in its displacement.

5. A toy nursing bottle as set forth in claim 1, wherein the end portion of the rod member is fixedly secured to the nipple for displacement therewith.

6. A toy nursing bottle as set forth in claim 1, wherein the rod member is fixed to and projects from the valve member and the end portion of the rod member is loosely received in the nipple, the toy nursing bottle further comprising spring means for biasing the valve member into engagement with the seat surface.

7. A toy nursing bottle as set forth in claim 6, wherein the inner shell has an end surface adjacent to the neck portion, a boss portion extending from said end surface, and a compression spring supported on said boss portion and engaging the valve member for biasing the same into engagement with the seat surface.

8. A toy nursing bottle for dolls having rigid lips and usable together with a container having a rigid portion, said nursing bottle comprising:

a bottle body having at least partially transparent outer and inner shells defining a liquid receiving chamber therebetween filled with a liquid simulating milk or other beverage, and a neck portion, the outer shall having an opening at an end thereof adjacent to the neck portion and communicating with the liquid receiving chamber;

a nipple member connected with the bottle body and including a compressible nipple and a wall having a seat surface and defining a liquid receiving reservoir between the nipple and the seat surface;

a cap integral with the bottle body and having an end portion connected with the neck portion of the bottle body and an opening at the end thereof remote from the end portion, the nipple having a portion defining said wall and located inside the cap with the nipple projecting through the cap opening;

valve means for controlling flow of liquid between the liquid receiving chamber of the bottle body and the liquid receiving reservoir of the nipple member, the valve means including a valve member engaging the seat surface to block flow of liquid therepast, and a rod member projecting from the valve member and having an end portion associated with the nipple, the rod member being displaceable with the nipple to displace the valve member away from the seat surface, upon pressing the nipple of at least a partially inclined bottle against the lips of a doll, to allow gravity flow of the simulating liquid from the liquid receiving reservoir in the nipple member, and upon pressing the nipple with the rigid surface of the container in the upright position of the bottle, to allow gravity flow of liquid from the liquid receiving reservoir in the nipple member into the liquid receiving chamber of the bottle body; and spring means for biasing the valve member into engagement with the seat surface.

* * * * *